US007625684B2

(12) United States Patent
Kamiyoshi et al.

(10) Patent No.: US 7,625,684 B2
(45) Date of Patent: Dec. 1, 2009

(54) TONER FOR ELECTROPHOTOGRAPHY

(75) Inventors: Nobumichi Kamiyoshi, Wakayama (JP); Koji Shimokusa, Wakayama (JP); Takashi Yamaguchi, Wakayama (JP); Shinichi Sata, Wakayama (JP)

(73) Assignee: Kao Corporation, Tokyo (JP)

( * ) Notice: Subject to any disclaimer, the term of this patent is extended or adjusted under 35 U.S.C. 154(b) by 848 days.

(21) Appl. No.: 11/172,834

(22) Filed: Jul. 5, 2005

(65) Prior Publication Data

US 2006/0029875 A1 Feb. 9, 2006

(30) Foreign Application Priority Data

Aug. 6, 2004 (JP) ..... 2004-231618
Sep. 22, 2004 (JP) ..... 2004-275491

(51) Int. Cl.
*G03G 9/087* (2006.01)

(52) U.S. Cl. ..... 430/109.4; 430/109.1; 430/123.54

(58) Field of Classification Search ..... 430/109.4, 430/109.1, 123.54
See application file for complete search history.

(56) References Cited

U.S. PATENT DOCUMENTS

2004/0132920 A1* 7/2004 Matsumura et al. ..... 525/418

OTHER PUBLICATIONS

Patent Abstracts of Japan, JP 11-249339, Sep. 17, 1999.
Patent Abstracts of Japan, JP 56-065146, Jun. 2, 1981.
Patent Abstracts of Japan, JP 4-120554, Apr. 21, 1992.

* cited by examiner

*Primary Examiner*—Mark F Huff
*Assistant Examiner*—Rachel L Burney
(74) *Attorney, Agent, or Firm*—Oblon, Spivak, McClelland, Maier & Neustadt, L.L.P.

(57) ABSTRACT

A toner for electrophotography containing a resin binder and a colorant, wherein the resin binder contains a polyester in an amount higher than 50% by weight of the resin binder, wherein the polyester is obtained by polycondensing an alcohol component containing 60% by mol or more of an aliphatic diol having 3 to 10 carbon atoms and a carboxylic acid component comprising 80% by mol or more of an aromatic dicarboxylic acid compound, the polyester having an index of crystallinity of from 0.6 to 1.5, and a glass transition temperature of 0° C. or more and less than 40° C. The toner for electrophotography of the present invention can be used for, for example, developing electrostatic latent images formed in electrophotography, electrostatic recording method, electrostatic printing method, or the like.

12 Claims, No Drawings

TONER FOR ELECTROPHOTOGRAPHY

FIELD OF THE INVENTION

The present invention relates to a toner for electrophotography used for, for example, developing an electrostatic latent image formed in electrophotography, electrostatic recording method, electrostatic printing method, or the like.

BACKGROUND OF THE INVENTION

Since a crystalline polyester has excellent low-temperature fixing ability but has poor durability, triboelectric stability under high-temperature high-humidity conditions, and blocking resistance, it is difficult to use the crystalline polyester alone as a resin binder for a toner, or use the crystalline polyester in an increased amount in the resin binder (see JP-A-Hei-11-249339 and JP-A-Sho-56-65146).

In addition, a toner containing a crystalline polyester alone by allowing the polyester to have a partial crystalline structure, thereby giving elasticity and excellent high-temperature offset property, has been reported. However, a further improvement in blocking resistance and triboelectric stability under high-temperature, high-humidity conditions has been desired (see JP-A-Hei-4-120554).

SUMMARY OF THE INVENTION

The present invention relates to:

[1] a toner for electrophotography containing a resin binder and a colorant, wherein the resin binder contains a polyester in an amount higher than 50% by weight of the resin binder, wherein the polyester is obtained by polycondensing an alcohol component containing 60% by mol or more of an aliphatic diol having 3 to 10 carbon atoms and a carboxylic acid component containing 80% by mol or more of an aromatic dicarboxylic acid compound, the polyester having an index of crystallinity of from 0.6 to 1.5, and a glass transition temperature of 0° C. or more and less than 40° C.; and

[2] a toner for electrophotography containing a resin binder and a colorant, wherein the resin binder contains a polyester in an amount higher than 50% by weight of the resin binder, wherein the polyester is obtainable by polycondensing an alcohol component containing 60% by mol or more of an aliphatic diol having 3 to 10 carbon atoms and a carboxylic acid component containing 80% by mol or more of an aromatic dicarboxylic acid compound, with the proviso that the carboxylic acid component contains 1 to 50% by mol of a polycyclic aromatic dicarboxylic acid compound having 12 or more carbon atoms, the polyester having an index of crystallinity of from 0.6 to 1.5, and a glass transition temperature of from 0° C. to 50° C.

DETAILED DESCRIPTION OF THE INVENTION

The present invention relates to a toner for electrophotography having excellent low-temperature fixing ability and blocking resistance without impairing its durability and triboelectric stability under high-temperature, high-humidity conditions.

The toner for electrophotography exhibits excellent effects of showing excellent low-temperature fixing ability and excellent blocking resistance without impairing its durability and triboelectric stability under high-temperature, high-humidity conditions.

These and other advantages of the present invention will be apparent from the following description.

There are the following First Embodiment and Second Embodiment for the toner for electrophotography of the present invention.

First Embodiment

A toner for electrophotography containing a resin binder and a colorant, wherein the above-mentioned resin binder contains a polyester in an amount higher than 50% by weight of the resin binder, wherein the polyester is obtained by polycondensing an alcohol component containing 60% by mol or more of an aliphatic diol having 3 to 10 carbon atoms and a carboxylic acid component containing 80% by mol or more of an aromatic dicarboxylic acid compound, the polyester having an index of crystallinity of from 0.6 to 1.5, and a glass transition temperature of 0° C. or more and less than 40° C.

Second Embodiment

A toner for electrophotography containing a resin binder and a colorant, wherein the resin binder contains a polyester in an amount higher than 50% by weight of the resin binder, wherein the polyester is obtainable by polycondensing an alcohol component containing 60% by mol or more of an aliphatic diol having 3 to 10 carbon atoms and a carboxylic acid component containing 80% by mol or more of an aromatic dicarboxylic acid compound, with the proviso that the carboxylic acid component contains 1 to 50% by mol of a polycyclic aromatic dicarboxylic acid compound having 12 or more carbon atoms, the polyester having an index of crystallinity of from 0.6 to 1.5, and a glass transition temperature of from 0° C. to 50° C.

The toners of First Embodiment and Second Embodiment are different in the monomer composition of the raw materials for polyester and the glass transition temperature, but both the toners contain a polyester having a high crystallinity in a high ratio, and share the properties of having excellent low-temperature fixing ability and being capable of satisfying both durability and triboelectric stability under high-temperature, high-humidity conditions. Conventionally, since the polyester having a high crystallinity has a disadvantage in durability and triboelectric stability under high-temperature, high-humidity conditions, even though its low-temperature fixing ability is excellent, it has been difficult to contain the polyester in a large amount in a resin binder for a toner. However, in the present invention, since the aromatic carboxylic acid compound is selected as raw material monomers for the polyester, the low-temperature fixing ability can be improved without impairing durability and triboelectric stability under high-temperature, high-humidity conditions even when the polyester having a high crystallinity is contained in a large amount.

The polyester having a high crystallinity (hereinafter referred to as "crystalline polyester") contained in the toner of the present invention refers to a polyester having a specified index of crystallinity. Specifically, in both First Embodiment and Second Embodiment, the polyester has an index of crystallinity of from 0.6 to 1.5, and the index of crystallinity is preferably from 0.8 to 1.3, more preferably from 0.9 to 1.1, and even more preferably from 0.98 to 1.05, from the viewpoint of low-temperature fixing ability. The term "index of crystallinity" as used herein refers to a property showing an extent of the crystallinity of the resin, which is defined by a ratio of the softening point to the highest temperature of endothermic peak, i.e. (softening point)/(highest temperature of endothermic peak). Generally, when the index of crystallinity exceeds 1.5, the resin is amorphous, and when the index of crystallinity is less than 0.6, the crystallinity is low, and much of the portions are amorphous. The extent of the crystallinity can be adjusted by the kinds of the raw material monomers and a ratio thereof, preparation conditions (for example, reaction temperature, reaction time, cooling rate), and the like. Here, the term "highest temperature of endothermic peak" refers to a temperature of the peak on the side of the highest temperature of the endothermic peak observed. When the difference between the highest temperature of endothermic peak and the softening point is 20° C. or less, the peak temperature is defined as a melting point, and when the difference between the highest temperature of endothermic peak and the softening point exceeds 20° C., the peak temperature is ascribed to a glass transition.

The polyester in the toner of First Embodiment is obtained by polycondensing an alcohol component containing 60% by mol or more of an aliphatic diol having 3 to 10 carbon atoms and a carboxylic acid component containing 80% by mol or more of an aromatic dicarboxylic acid compound, and it is desired that the polyester is prepared by polycondensing an alcohol component containing 80% by mol or more of an aliphatic diol having 4 to 10 carbon atoms and a carboxylic acid component containing 80% by mol or more of an aromatic dicarboxylic acid compound.

It is preferable that the aliphatic diol having 3 to 10 carbon atoms is a linear aliphatic diol having 4 to 10 carbon atoms, a branched aliphatic diol having 3 to 10 carbon atoms, or a mixture thereof. Since the resin binder contains a polyester having a high crystallinity obtainable from an alcohol component containing a linear aliphatic diol as a main component, and further containing a branched aliphatic diol, and a carboxylic acid component containing an aromatic carboxylic acid compound, used as raw material monomers, the low-temperature fixing ability can be further improved without impairing blocking resistance even when the polyester having a high crystallinity is contained in a large amount. The term "branched aliphatic diol" as used herein refers to a diol having a branched alkylene group to which two OH groups are bonded, or a diol having a secondary OH group.

The linear aliphatic diol having 4 to 10 carbon atoms includes 1,4-butanediol, 1,5-pentanediol, 1,6-hexanediol, 1,7-heptanediol, 1,8-octanediol, 1,9-nonanediol, 1,10-decanediol, 1,4-butenediol, and the like. Among them, α,ω-alkanediols are preferable, and 1,4-butanediol, 1,6-hexanediol, 1,8-octanediol, and 1,10-decanediol are more preferable, from the viewpoint of enhancement of the crystallinity.

The content of the linear aliphatic diol having 4 to 10 carbon atoms in the alcohol component is preferably from 50 to 90% by mol, and the content is more preferably from 60 to 90% by mol, and even more preferably from 70 to 90% by mol, from the viewpoint of enhancement of the crystallinity.

The branched aliphatic diol having 3 to 10 carbon atoms includes 1,2-propanediol, 1,3-butanediol, neopentyl glycol, 2-butyl-2-ethyl-1,3-propanediol, and the like.

The content of the branched aliphatic diol having 3 to 10 carbon atoms in the alcohol component is preferably from 10 to 50% by mol, and the content is more preferably from 10 to 40% by mol, and even more preferably from 10 to 30% by mol, from the viewpoint of improving the low-temperature fixing ability.

The molar ratio of the linear aliphatic diol having 4 to 10 carbon atoms to the branched aliphatic diol having 3 to 10 carbon atoms (the linear aliphatic diol having 4 to 10 carbon atoms/the branched aliphatic diol having 3 to 10 carbon atoms) is preferably from 60/40 to 90/10, more preferably from 70/30 to 85/15, and even more preferably from 70/30 to 80/20, from the viewpoint of low-temperature fixing ability.

The content of the aliphatic diol having 3 to 10 carbon atoms in the alcohol component is 60% by mol or more, preferably 80% by mol or more, and the content is more preferably 85% by mol or more, and even more preferably from 90 to 100% by mol, from the viewpoint of enhancement of the crystallinity.

An alcohol other than the above-mentioned aliphatic diol having 3 to 10 carbon atoms may be contained in the alcohol component within the range so as not to impair the effects of the present invention. The alcohol component includes an aliphatic diol other than the aliphatic diol having 3 to 10 carbon atoms, such as ethylene glycol; an aromatic diol such as an alkylene oxide adduct of bisphenol A as represented by polyoxypropylene(2.2)-2,2-bis(4-hydroxyphenyl)propane, and polyoxyethylene(2.2)-2,2-bis(4-hydroxyphenyl)propane; an alicyclic diol such as 1,4-cyclohexanedimethanol; a trihydric or higher polyhydric alcohol such as glycerol and pentaerythritol; and the like.

The aromatic dicarboxylic acid compound is preferably a compound having a benzene unit, such as phthalic acid, isophthalic acid, terephthalic acid, and a derivative thereof such as an acid anhydride thereof and an alkyl(1 to 3 carbon atoms) ester thereof. Among them, terephthalic acid and a derivative thereof are more preferable, from the viewpoint of enhancement of the crystallinity.

The content of the aromatic dicarboxylic acid compound in the carboxylic acid component is 80% by mol or more, and the content is preferably 85% by mol or more, and more preferably from 90 to 100% by mol, from the viewpoint of low-temperature fixing ability, durability, and triboelectric stability under high-temperature, high-humidity conditions.

The carboxylic acid component other than the above-mentioned aromatic dicarboxylic acid compound includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acids; tricarboxylic or higher polycarboxylic acids such as trimellitic acid and pyromellitic acid; and derivatives thereof such as anhydrides thereof, alkyl(1 to 3 carbon atoms) esters thereof; and the like. Among them, the aliphatic dicarboxylic compounds are preferable, and fumaric acid and a derivative thereof are more preferable, from the viewpoint of enhancement of the crystallinity.

On the other hand, the polyester in the toner of Second Embodiment is obtainable by polycondensing an alcohol component containing 60% by mol or more of an aliphatic diol having 3 to 10 carbon atoms and a carboxylic acid component containing 80% by mol or more of an aromatic dicarboxylic acid compound, with the proviso that the carboxylic acid component contains 1 to 50% by mol of a polycyclic aromatic dicarboxylic acid compound having 12 or more carbon atoms, and it is desired that a polyester is obtainable by polycondensing an alcohol component containing 80% by mol or more of an aliphatic diol having 4 to 10 carbon atoms and a carboxylic acid component containing 80% by mol or more of an aromatic dicarboxylic acid compound, with the proviso that the carboxylic acid component contains 1 to 50% by mol of a polycyclic aromatic dicarboxylic acid compound having 12 or more carbon atoms.

As the alcohol component, the same ones as those in First Embodiment may be included.

As to the carboxylic acid component, Second Embodiment is common with First Embodiment in that the aromatic dicarboxylic acid compound is contained in a specified amount or more, and the feature of Second Embodiment further resides in that the carboxylic acid component contains a polycyclic aromatic dicarboxylic compound having 12 or more carbon atoms in a specified amount.

The polycyclic aromatic dicarboxylic compound having 12 or more carbon atoms is preferably a compound having a benzene unit, such as 2,6-naphthalenedicarboxylic acid, 1,5-naphthalenedicarboxylic acid, 2,7-naphthalenedicarboxylic acid, 1,4-naphthalenedicarboxylic acid, 4,4-biphenyldicarboxylic acid, and derivatives thereof such as acid anhydrides thereof and alkyl (1 to 3 carbon atoms) esters thereof. The number of carbon atoms of the polycyclic aromatic dicarboxylic acid compound is preferably from 12 to 30, and more preferably from 12 to 24. Among them, 2,6-naphthalenedicarboxylic acid and 1,5-naphthalenedicarboxylic acid are preferable, from the viewpoint of the crystallinity of the polyester.

The content of the polycyclic aromatic dicarboxylic compound having 12 or more carbon atoms in the carboxylic acid component in Second Embodiment is from 1 to 50% by mol, and the content is preferably from 5 to 40% by mol, and more preferably from 10 to 30% by mol, from the viewpoint of crystallinity of the polyester and low-temperature fixing ability of the toner.

Further, a total content of the above-mentioned polycyclic aromatic dicarboxylic compound and the aromatic dicarboxylic acid compound exemplified in First Embodiment in the carboxylic acid component is 80% by mol or more, and the content is preferably 85% by mol or more, and more preferably from 90 to 100% by mol, from the viewpoint of low-temperature fixing ability, durability, and triboelectric stability under high-temperature, high-humidity conditions.

As the carboxylic acid component other than the aromatic dicarboxylic acid compound, the same ones as those in First Embodiment are included.

In both First Embodiment and Second Embodiment, the molar ratio of the alcohol component to the carboxylic acid component (the alcohol component/the carboxylic acid component) is preferably from 100/70 to 100/120, and more preferably from 100/85 to 100/105, from the viewpoint of fixing ability to paper and triboelectric stability.

In both First Embodiment and Second Embodiment, the polyester is preferably prepared, for instance, by polycondensing the alcohol component and the carboxylic acid component at a temperature of preferably from 150° C. to 280° C., and more preferably from 200° C. to 250° C., for example, in an inert gas atmosphere, in the presence of an esterification catalyst as occasion demands, from the viewpoint of productivity.

The polyester has a highest temperature of endothermic peak is preferably from 60° C. to 150° C., more preferably from 65° C. to 140° C., and even more preferably from 70° C. to 130° C., from the viewpoint of low-temperature fixing ability. The highest temperature of endothermic peak as used herein is determined with a differential scanning calorimeter.

The glass transition temperatures of the polyester differ in First Embodiment and Second Embodiment. The glass transition temperature is a property inherently owned by the amorphous portion in the resin, which may be generally observed in an amorphous polyester, or may be also observed in an amorphous portion of a crystalline polyester in some cases.

The polyester in First Embodiment has a glass transition temperature of 0° C. or more and less than 40° C., preferably 10° C. or more and less than 40° C., and more preferably 20° C. or more and less than 40° C., from the viewpoint of blocking resistance and low-temperature fixing ability.

The polyester in Second Embodiment has a glass transition temperature of from 0° C. to 50° C., preferably from 10° C. to 50° C., and more preferably from 20° C. to 50° C., from the viewpoint of blocking resistance and low-temperature fixing ability.

In both First Embodiment and Second Embodiment, the polyester has an acid value of preferably from 1 to 50 mg KOH/g, more preferably from 10 to 45 mg KOH/g, and even more preferably from 15 to 40 mg KOH/g, from the viewpoint of environmental stability and fixing ability to a paper. The acid value as used herein refers to an amount expressed by mg of potassium hydroxide required for neutralizing an acid contained in a 1 g sample.

In both First Embodiment and Second Embodiment, it is preferable that the polyester has a saturated water content under specified high-temperature, high-humidity conditions within a given range, from the viewpoint of chargeability of the toner. Specifically, the polyester has a saturated water content of preferably from 0.1 to 0.8% by weight, more preferably from 0.1 to 0.7% by weight, and even more preferably from 0.1 to 0.6% by weight under environmental conditions of a temperature of 40° C. and relative humidity of 90%. When the polyester has a saturated water content of 0.1% by weight or more, the water content on the toner surface can be secured, so that the leakage of electric charges is properly generated, whereby the increase in the triboelectric charges of the toner, and the generation of overcharging toner can be suppressed. Further, lowering of the image densities and the background fog presumably caused by reversely charged toners generated by frictions or the like between the overcharging toner and a normal toner are likely to be suppressed. In addition, when the polyester has a saturated water content of 0.8% by weight or less, the generation of leakage of triboelectric charging of the toner and the generation of background fog caused by lowering of the absolute value of the triboelectric charges can be more effectively suppressed. The phrase "a saturated water content in the polyester under the environmental conditions of a temperature of 40° C. and a relative humidity of 90%" refers to a water content contained in a polyester after being allowed to stand under the conditions of a temperature of 40° C. and a relative humidity of 90% for 24 hours.

In both First Embodiment and Second Embodiment, it is necessary that the content of the polyester in the resin binder is larger than 50% by weight, more preferably 70% by weight or more, and even more preferably 80% by weight or more, from the viewpoint of low-temperature fixing ability.

The resin binder includes the crystalline polyester, amorphous polyesters, polyester-polyamides, vinyl resins such as styrene-acrylic resins, hybrid resins containing a plural resin components. Among the resins other than the crystalline polyester, the amorphous polyester, and the hybrid resin in which an amorphous polyester component and a vinyl resin component are partially chemically bonded to each other are preferable, and the amorphous polyester is more preferable, from the viewpoint of compatibility with the crystalline polyester and fixing ability of the toner.

The colorant includes known colorants, without particular limitation, and can be properly selected according to its purposes. Specifically, the colorant includes various pigments such as carbon blacks, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green, and Malachite Green Oxalate; and various dyes such as Acridine dyes, Xanthene dyes, azo dyes, benzoquinone dyes, Azine dyes, anthraquinone dyes, indigo dyes, thioindigo dyes, Phthalocyanine dyes, Aniline Black dyes, polymethine dyes, triphenylmethane dyes, diphenylmethane dyes, thiazine dyes, thiazole dyes, and xanthene dyes, and these pigments and dyes can be used alone or in admixture of two or more kinds.

Further, the toner of the present invention may appropriately contain an additive such as a charge control agent, a releasing agent, a magnetic powder, an electric conductivity modifier, an extender, a reinforcing filler such as a fibrous substance, an antioxidant, an anti-aging agent, a fluidity improver, or a cleanability improver.

The releasing agent usable in the toner of the present invention includes natural waxes such as carnauba wax and rice wax; synthetic waxes such as polypropylene wax, polyethylene wax, and Sazole wax; and coal waxes such as montan wax; and the like. Among them, the polyethylene wax and the carnauba wax are preferable from the viewpoint of offset resistance.

The releasing agent has a melting point of preferably from 50° C. to 100° C., and more preferably from 70° C. to 90° C., from the viewpoint of fixable region and color reproducibility. In addition, the content of the releasing agent is preferably from 1 to 10 parts by weight, and more preferably from 1.5 to 5 parts by weight, based on 100 parts by weight of the resin binder.

The toner of the present invention can be prepared according to any of conventionally known methods such as a kneading-pulverization method, a spray-drying method, or a polymerization method. As a general process, for example, the toner can be prepared by homogeneously mixing a resin binder, a colorant, a charge control agent and the like in a mixer such as a Henschel mixer, thereafter melt-kneading with a closed kneader, a single-screw or twin-screw extruder or the like, cooling, pulverizing and classifying the product. The embodiments for addition of the releasing agent are not particularly limited, and it is preferable that the releasing agent is mixed together with a resin binder and a colorant during the preparation of the toner with a Henschel mixer or the like. In addition, as long as the releasing agent does not have a functional group, the releasing agent may be previously added in the process of preparing the polyester. Further, a fluidity improver such as hydrophobic silica may be added to a roughly pulverized product during the preparation process, or to a toner surface obtained as occasion demands. The weight-average particle size ($D_4$) or the volume-median particle size ($D_{50}$) of the toner of the present invention is preferably from 3 to 15 μm, and more preferably from 4 to 8 μm.

The toner for electrophotography of the present invention can be used alone as a developer in the case where fine magnetic material powder is contained, or as a nonmagnetic monocomponent developer, or as a two-component developer by mixing the toner with a carrier, in the case where fine magnetic material powder is not contained.

EXAMPLES

The following examples further describe and demonstrate embodiments of the present invention. The examples are given solely for the purposes of illustration and are not to be construed as limitations of the present invention.

1. Acid Value and Hydroxyl Value of Resins (1) Acid value: Determined according to JIS K0070.

(2) Hydroxyl value: Determined according to JIS K0070.

2. Softening Point, Highest Temperature of Endothermic Peak, Melting Point, and Glass Transition Temperature of Resins (1) Softening Point The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

(2) Highest Temperature of Endothermic Peak and Melting Point

The highest temperature of endothermic peak is determined using a differential scanning calorimeter ("DSC 210," commercially available from Seiko Instruments, Inc.), by raising its temperature to 200° C., cooling the hot sample from this temperature to 0° C. at a cooling rate of 10° C./min, and thereafter heating the sample so as to raise the temperature at a rate of 10° C./min. Among the endothermic peaks observed, the temperature of an endothermic peak on the highest temperature side is defined as a highest temperature of endothermic peak. When a difference between the highest temperature of endothermic peak and the softening point is within 20° C., the peak temperature is defined as a melting point. When the highest temperature of endothermic peak is equal to or lower than the temperature calculated from the softening minus 20° C., the peak is ascribed to glass transition.

(3) Glass Transition Temperature

The glass transition temperature is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a rate of 10° C./min. When a peak is observed at a temperature equal to or lower than the temperature calculated from the softening point minus 20° C., the peak temperature thereof is read off as a glass transition temperature, and when a shift of the curve is observed without any observations of peaks at a temperature equal to or lower than the temperature calculated from the softening point minus 20° C., the temperature of an intersection of the tangential line having the maximum inclination of the curve in the portion of the curve shift and the extended baseline of the high-temperature side of the curve shift is read off as a glass transition temperature.

3. Index of Crystallinity for Resins

The index of crystallinity is calculated as a degree of the crystallinity by from the softening point and the temperature of the highest temperature of endothermic peak determined in accordance with the methods mentioned above using the following formula.

$$\text{Index of Crystallinity} = \frac{\text{Softening Point}}{\text{Highest Temperature of Endothermic Peak}}$$

4. Saturated Water Content of Resin

The saturated water content of resin refers to a water content of the resin determined with an infrared moisture determination balance ("FD-230," commercially available from Kett Electric Laboratory) after the resin is allowed to stand for 24 hours under environmental conditions of a temperature of 40° C. and relative humidity of 90%.

5. Melting Point of Releasing Agent

The melting point is determined using a differential scanning calorimeter ("DSC 210," commercially available from Seiko Instruments, Inc.), by raising its temperature to 200° C., cooling the sample from this temperature to 0° C. at a cooling rate of 10C/min, and thereafter raising the temperature of the sample at a rate of 10° C./min. The peak temperature observed is read off as a melting point.

Preparation Example 1 of Crystalline Polyester

A 5-liter four-necked flask equipped with a nitrogen inlet tube, a dehydration tube, a stirrer, and a thermocouple was charged with the raw material monomers as shown in Tables 1 and 2 and 10 g of butyltin oxide, and the ingredients were reacted at 200° C. until granules of terephthalic acid and isophthalic acid were not observed. Thereafter, the ingredients were further reacted at 8.3 kPa for 1 hour, to give resins A to E, J, and K.

Preparation Example 2 of Crystalline Polyester

A 5-liter four-necked flask equipped with a nitrogen inlet tube, a dehydration tube, a stirrer, and a thermocouple was charged with the raw material monomers as shown in Table 2 and 10 g of dibutyltin oxide. The ingredients were reacted at 160° C. for 5 hours, heated to 200° C., and reacted for 1 hour. Thereafter, the ingredients were further reacted at 8.3 kPa for 1 hour, to give resins F to H.

Preparation Example 3 of Crystalline Polyester

A 5-liter four-necked flask equipped with a nitrogen inlet tube, a dehydration tube, a stirrer, and a thermocouple was charged with the raw material monomers as shown in Table 2 and 10 g of butyltin oxide. The ingredients were reacted at 200° C. until granules of terephthalic acid and isophthalic acid were not observed. Thereafter, the ingredients were further reacted at 8.3 kPa for 4 hours, to give a resin I.

TABLE 1

| Crystalline Polyester | Resin A | Resin B | Resin C | Resin D | Resin E |
|---|---|---|---|---|---|
| Alcohol Component | | | | | |
| 1,4-Butanediol | — | — | — | — | — |
| 1,6-Hexanediol | 1926 g (100) | 1652 g (80) | 1888 g (80) | 1888 g (80) | 2166 g (102) |
| Neopentyl Glycol | — | 364 g (20) | — | — | — |
| 1,4-Cyclohexanedimethanol (Cis-trans mixture) | — | — | 576 g (20) | — | — |
| Ethylene Glycol | — | — | — | 248 g (20) | — |
| 1,2-Propanediol | — | — | — | — | — |
| Carboxylic Acid Component | | | | | |
| Terephthalic Acid | 2656 g (100) | 2905 g (100) | 3320 g (100) | 2988 g (90) | 2390 g (80) |
| Isophthalic acid | — | — | — | — | 598 g (20) |
| Fumaric Acid | — | — | — | — | — |
| Succinic Acid | — | — | — | — | — |
| 2,6-Dimethyl Naphthalenedicarboxylate | — | — | — | — | — |
| Properties of Resin | | | | | |
| Softening Point (° C.) | 145.6 | 115.6 | 137.0 | 121.3 | 116.6 |
| Highest Temperature (° C.) of Endothermic Peak | 147.1 | 118.6 | 134.6 | 129.8 | 123.0 |
| Glass Transition Temperature (° C.) | 34.9 | 15.5 | 34.1 | 37.7 | 13.0 |
| Acid Value (mgKOH/g) | 33.0 | 35.0 | 37.6 | 13.1 | 29.3 |
| Index of Crystallinity | 0.99 | 0.97 | 1.02 | 0.93 | 0.95 |
| Saturated Water Content of Resin (% by weight) | 0.45 | 0.57 | 0.59 | 1 | 0.44 |

Note)
The values for alcohol components and carboxylic acid components in parentheses are expressed by molar ratios when the total amount of the alcohol component is defined as 100 moles.

TABLE 2

| Crystalline Polyester | Resin F | Resin G | Resin H | Resin I | Resin J | Resin K |
|---|---|---|---|---|---|---|
| Alcohol Component | | | | | | |
| 1,4-Butanediol | 2250 g (100) | — | — | — | — | — |
| 1,6-Hexanediol | — | 2596 g (100) | — | 1699 g (80) | 1742 g (82) | 1888 g (100) |
| Neopentyl Glycol | — | — | — | 374 g (20) | — | — |
| 1,4-Cyclohexanedimethanol (Cis-trans mixture) | — | — | — | — | — | — |
| Ethylene Glycol | — | — | 1705 g (100) | — | — | — |
| 1,2-Propanediol | — | — | — | — | 274 g (20) | — |

TABLE 2-continued

| Crystalline Polyester | Resin F | Resin G | Resin H | Resin I | Resin J | Resin K |
|---|---|---|---|---|---|---|
| Carboxylic Acid Component | | | | | | |
| Terephthalic Acid | — | — | — | 2988 g (100) | 2988 g (100) | 1328 g (50) |
| Isophthalic acid | — | — | — | — | — | — |
| Fumaric Acid | 2900 g (100) | 2552 g (100) | — | — | — | — |
| Succinic Acid | — | — | 3245 g (100) | — | — | — |
| 2,6-Dimethyl Naphthalenedicarboxylate | — | — | — | — | — | 1952 g (50) |
| Properties of Resin | | | | | | |
| Softening Point (° C.) | 132.9 | 111.5 | 102.0 | 120.5 | 121.7 | 135.8 |
| Highest Temperature (° C.) of Endothermic Peak | 137.7 | 115.1 | 104.5 | 121.6 | 127.4 | 147.8 |
| Glass Transition Temperature (° C.) | −18.2 | −18.1 | −14.9 | 17.7 | 19.8 | 20.9 |
| Acid Value (mgKOH/g) | 52.6 | 29.8 | 38.1 | 35.7 | 26.2 | 46.8 |
| Index of Crystallinity | 0.97 | 0.97 | 0.98 | 0.99 | 0.96 | 0.45 |
| Saturated Water Content of Resin (% by weight) | 1.5 | 0.94 | 1.1 | 0.51 | 0.56 | 0.92 |

Note)
The values for alcohol components and carboxylic acid components in parentheses are expressed by molar ratios when the total amount of the alcohol component is defined as 100 moles.

Examples 1-1 to 1-5 and Comparative Examples 1-1 to 1-3

One-hundred parts by weight of the resin binder as shown in Table 3, 6 parts by weight of a carbon black "MOGUL-L" (commercially available from Cabot Corporation) as a colorant, 1 part by weight of "BONTRON S-34" (commercially available from Orient Chemical Co., Ltd.) as a negatively chargeable charge control agent, and 2 parts by weight of "NP-105" (commercially available from SANYO CHEMICAL INDUSTRIES, LTD., melting point: 140° C.) as a releasing agent were sufficiently mixed together with a Henschel mixer. Thereafter, the mixture was melt-kneaded with a twin-screw extruder "PCM-30" (commercially available from IKEGAI Corporation) at a feeding rate of 10 kg/min, a rotational speed of 200 r/min, and a kneading temperature of a temperature calculated from the melting point of the resin binder−(minus)10° C. One-hundred parts by weight of the kneaded mixture was treated with 0.5 parts by weight of a hydrophobic silica "AEROSIL R-972" (commercially available from Nippon Aerosil) using a Henschel mixer while mixing. Thereafter, the mixture was finely pulverized with a jet mill and classified with an airflow classifier, to give a powder having a weight-average particle size of 8.5 μm.

One-hundred parts by weight of the resulting powder was treated with 1 part by weight of a hydrophobic silica "AEROSIL R-972" (commercially available from Nippon Aerosil) using a Henschel mixer while mixing, to give a negatively chargeable toner.

Test Example 1-1 [Low-Temperature Fixing Ability]

Seven-hundred and sixty grams of a silicone-coated ferrite carrier (commercially available from Kanto Denka Kogyo Co., Ltd.) having an average particle size (volume-median particle size ($D_{50}$)) of 60 μm was added to 52 g of the toner while mixing, to give a developer. The developer obtained was loaded on a commercially available copy machine (commercially available from Sharp Corporation, "DIGITAL IMAGER AR-505") to develop unfixed solid images, to give an unfixed image. A fixing test was carried out with a silicone oil applying type fixing device (fixing speed: 160 mm/sec), while sequentially raising the temperature from 100° C. to 200° C. in increments of 10° C.

The image density of the solid image fixed at each temperature was determined with a densitometer "TR-927" (commercially available from GregtagMacbeth AG, color transmission). Thereafter, the printout was set on a rubbing testing machine equipped with a metal blade, and a blank sheet, the same one as the printout, was wound around the contact surface of the blade with the printout. The solid image portion was rubbed backward and forward 10 times each with a metal blade to which a 1 kg load was applied. The image density after rubbing was again determined, and the rubbing residual ratio was calculated by the following equation. The lowest temperature of the fixing roller at which the rubbing residual ratio exceeds 80% is defined as the lowest fixing temperature. The low-temperature fixing ability was evaluated in accordance with the following evaluation criteria. The results are shown in Table 3.

$$\text{Rubbing Residual Ratio (\%)} = \frac{\text{Image Density After Rubbing}}{\text{Image Density Before Rubbing}} \times 100$$

[Evaluation Criteria]

◎: Lowest fixing temperature being lower than 120° C.;

○: Lowest fixing temperature being 120° C. or higher and lower than 160° C.; and x: Lowest fixing temperature being 160° C. or higher.

Test Example 1-2 [Storage Stability Under High-Temperature, High-Humidity Conditions]

Two 20 ml polyethylene bottles were prepared, each bottle being charged with 9.4 g of a silicone-coated ferrite carrier (commercially available from Kanto Denka Kogyo Co., Ltd.) having an average particle size (volume-median particle size ($D_{50}$)) of 60 μm to 0.6 g of a toner. Both bottles were in unsealed state, and the toner in one bottle was allowed to stand for 24 hours under normal-temperature, normal-humidity (NN) environmental conditions of a temperature of 25° C. and relative humidity of 50%, and the toner in the other bottle was allowed to stand for 24 hours under high-temperature, high-humidity (HH) environmental conditions of a temperature of 40° C. and relative humidity of 90%. After allowed to stand, the toner and the carrier were mixed for 5 minutes with a turbuler mixer under each of environmental conditions. The triboelectric charge of the toner was determined with a q/m meter (commercially available from Epping GmbH). The value of (triboelectric charge (μC/g) under the HH environment)/(triboelectric charge (μC/g) under the NN environment), i.e. HH/NN, was calculated. The storage stability under high-temperature, high-humidity conditions was evaluated in accordance with the following evaluation criteria. The results are shown in Table 3.

[Evaluation Criteria]

◎: The HH/NN being 0.8 or more;

○: The HH/NN being 0.6 or more and less than 0.8; and x: The HH/NN being less than 0.6.

Test Example 1-3 [Blocking Resistance]

A 20 ml polyester bottle was charged with 4 g of a toner and the toner was allowed to stand under environmental conditions of a temperature of 50° C. for 48 hours. Thereafter, three sieves comprising an upper sieve having a sieve opening of 250 μm, a middle sieve having a sieve opening of 150 μm, and a lower sieve having a sieve opening of 75 μm were serially arranged in a powder tester (commercially available from Hosokawa Micron Corporation). And 4 g of the above toner was supplied to the upper sieve, and vibration was applied at a frequency of 0.7 mm for 1 minute. After vibration, the weight (g) of the toner remaining on each sieve was weighed, and the extent of aggregation was determined by the following formula:

Extent of Aggregation=25×(Amount of Toner Remaining on Upper Sieve)+15×(Amount of Toner Remaining on Middle Sieve)+5×(Amount of Toner Remaining on Lower Sieve)

The blocking resistance was evaluated in accordance with the following evaluation criteria. The results are shown in Table 3.

[Evaluation Criteria]

◎: The extent of aggregation being less than 10;

○: The extent of aggregation being 10 or more and less than 20; and x: The extent of aggregation being 20 or more.

TABLE 3

| | Resin Binder | Low-Temp. Fixing Ability | Lowest Fixing Temp. (° C.) | Storage Stability under High-Temp. and High-Humidity Environmental Conditions | Blocking Resistance |
|---|---|---|---|---|---|
| Ex. 1-1 | Resin A | ○ | 150 | ◎ | ◎ |
| Ex. 1-2 | Resin B | ◎ | 100 | ◎ | ○ |
| Ex. 1-3 | Resin C | ○ | 150 | ◎ | ○ |
| Ex. 1-4 | Resin D | ○ | 130 | ○ | ◎ |
| Ex. 1-5 | Resin E | ○ | 120 | ○ | ◎ |
| Comp. Ex. 1-1 | Resin F | X | 180 | X | ◎ |
| Comp. Ex. 1-2 | Resin G | X | 160 | X | ◎ |
| Comp. Ex. 1-3 | Resin H | Δ | 150 | X | ○ |

Examples 2-1 to 2-6 and Example 3-1

One-hundred parts by weight of the resin binder as shown in Table 4, 6 parts by weight of a carbon black "MOGUL-L" (commercially available from Cabot Corporation) as a colorant, 1 part by weight of "BONTRON S-34" (commercially available from Orient Chemical Co., Ltd.) as a negatively chargeable charge control agent, and 2 parts by weight of "HNP-9" (commercially available from NIPPON SEIRO CO., LTD., melting point: 75° C.) as a releasing agent were sufficiently mixed together with a Henschel mixer. Thereafter, the mixture was melt-kneaded with a twin-screw extruder "PCM-30" (commercially available from IKEGAI Corporation) at a feeding rate of 10 kg/min, a rotational speed of 200 r/min and a kneading temperature of a temperature calculated from the melting point of the resin binder−(minus)10° C. One-hundred parts by weight of the kneaded mixture was treated with 0.5 parts by weight of a hydrophobic silica "AEROSIL R-972" (commercially available from Nippon Aerosil) using a Henschel mixer while mixing. Thereafter, the mixture was finely pulverized with a jet mill and classified with an airflow classifier, to give a powder having a volume-median particle size ($D_{50}$) of 8.5 μm.

One-hundred parts by weight of the resulting powder was treated with 1 part by weight of a hydrophobic silica "AEROSIL R-972" (commercially available from Nippon Aerosil) using a Henschel mixer while mixing, to give a negatively chargeable toner.

Test Example 2-1 [Fixing Ability]

A fixing test was carried out in the same manner as in Test Example 1-1. The low-temperature fixing ability was evaluated in accordance with the following evaluation criteria. The results are shown in Table 4.

[Evaluation Criteria]

◎: Lowest fixing temperature being lower than 115° C.;

○: Lowest fixing temperature being 115° C. or higher and lower than 130° C.; and x: Lowest fixing temperature being 130° C. or higher.

Test Example 2-2

The storage stability under high-temperature, high-humidity environmental conditions was evaluated in the same manner as in Test Example 1-2. The results are shown in Table 4.

Test Example 2-3

The blocking resistance was evaluated in the same manner as in Test Example 1-3. The results are shown in Table 4.

TABLE 4

| | Resin Binder | Low-Temp. Fixing Ability | Lowest Fixing Temp. (° C.) | Storage Stability under High-Temp. and High-Humidity Environmental Conditions | Blocking Resistance |
|---|---|---|---|---|---|
| Ex. 2-1 | Resin B | ◎ | 100 | ◎ | ○ |
| Ex. 2-2 | Resin I | ◎ | 110 | ◎ | ◎ |
| Ex. 2-3 | Resin J | ◎ | 110 | ◎ | ◎ |
| Ex. 2-4 | Resin A | X | 150 | ◎ | ◎ |
| Ex. 2-5 | Resin C | X | 150 | ◎ | ○ |
| Ex. 2-6 | Resin D | X | 130 | ○ | ◎ |
| Ex. 3-1 | Resin K | X | 150 | ◎ | ○ |

The results shown in Tables 3 and 4 are shown together in Table 5. Here, the low-temperature fixing ability was reevaluated in accordance with the following evaluation criteria.

[Evaluation Criteria of Low-Temperature Fixing Ability]

5: Lowest fixing temperature being lower than 115° C.;

4: Lowest fixing temperature being 115° C. or higher and lower than 120° C.;

3: Lowest fixing temperature being 120° C. or higher and lower than 130° C.;

2: Lowest fixing temperature being 130° C. or higher and lower than 160° C.; and 1: Lowest fixing temperature being 160° C. or higher.

TABLE 5

| | Resin Binder | Low-Temp. Fixing Ability | Lowest Fixing Temp. (° C.) | Storage Stability under High-Temp. and High-Humidity Environmental Conditions | Blocking Resistance |
|---|---|---|---|---|---|
| Ex. 1-1 | Resin A | 2 | 150 | ◎ | ◎ |
| Ex. 1-2 | Resin B | 5 | 100 | ◎ | ○ |
| Ex. 1-3 | Resin C | 2 | 150 | ◎ | ○ |
| Ex. 1-4 | Resin D | 2 | 130 | ○ | ◎ |
| Ex. 1-5 | Resin E | 3 | 120 | ○ | ◎ |
| Ex. 2-1 | Resin B | 5 | 100 | ◎ | ○ |
| Ex. 2-2 | Resin I | 5 | 110 | ◎ | ◎ |
| Ex. 2-3 | Resin J | 5 | 110 | ◎ | ◎ |
| Ex. 2-4 | Resin A | 2 | 150 | ◎ | ◎ |
| Ex. 2-5 | Resin C | 2 | 150 | ◎ | ○ |
| Ex. 2-6 | Resin D | 2 | 130 | ○ | ◎ |
| Ex. 3-1 | Resin K | 2 | 150 | ◎ | ○ |
| Comp. Ex. 1-1 | Resin F | 1 | 180 | X | ◎ |
| Comp. Ex. 1-2 | Resin G | 1 | 160 | X | ◎ |
| Comp. Ex. 1-3 | Resin H | 2 | 150 | X | ○ |

The toners of Examples 1-2,2-1, and 2-2 were further subjected to a test of Test Example 3-1 given hereinbelow, to evaluate a high-temperature fixing ability. The results are shown in Table 6.

Test Example 3-1 [High-Temperature Fixing Ability]

Seven-hundred and sixty grams of a silicone-coated ferrite carrier (commercially available from Kanto Denka Kogyo Co., Ltd.) having an average particle size (volume-median particle size ($D_{50}$)) of 60 μm was added to 52 g of the toner while mixing, to give a developer. The developer obtained was loaded on a commercially available copy machine (commercially available from Sharp Corporation, "DIGITAL IMAGER AR-505") to develop unfixed solid images, to give an unfixed image. A fixing test was carried out with a fixing device (fixing speed: 160 mm/sec) to which a silicone oil was not applied, while sequentially raising the temperature from 100° C. to 200° C. in increments of 10° C. to determine the hot-offset generation temperature. The highest fixing temperature is defined as the temperature immediately before the generation of the hot offset.

TABLE 6

| | Resin Binder | Low-Temp. Fixing Ability | Lowest Fixing Temp. (° C.) | Storage Stability under High-Temp. and High-Humidity Environmental Conditions | Blocking Resistance | High-Temp. Fixing Ability (Highest Fixing Temp., ° C.) |
|---|---|---|---|---|---|---|
| Ex. 1-2 | Resin B | 5 | 100 | ◎ | ○ | 140 |
| Ex. 2-1 | Resin B | 5 | 100 | ◎ | ○ | 180 |
| Ex. 2-2 | Resin I | 5 | 110 | ◎ | ◎ | 200 |

It can be seen from the above results that the toners of Examples are satisfactory in all of low-temperature fixing ability, storage stability, and blocking resistance, as compared to the toners of Comparative Examples.

Especially, it can be seen that the toners of Examples 1-2 and 2-1 to 2-3 containing crystalline polyester obtained from an alcohol component containing a linear aliphatic diol as a main component, further containing a branched aliphatic diol and a carboxylic acid component containing an aromatic carboxylic acid compound as raw material monomers are outstandingly excellent in low-temperature fixing ability.

Further, it can be seen that a fixable range is especially broadened by containing a releasing agent having a low melting point, by comparing the results of Example 1-2 with those of Examples 2-1 and 2-2 in high-temperature fixing ability.

The toner for electrophotography of the present invention can be used for, for example, developing electrostatic latent images formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrophotography comprising a resin binder and a colorant, wherein the resin binder comprises a crystalline polyester in an amount 80% or more by weight of the resin binder, wherein the polyester is obtained by polycondensing an alcohol component comprising 60% by mol or more of an aliphatic diol having 3 to 10 carbon atoms and a carboxylic acid component comprising 80% by mol or more of an aromatic dicarboxylic acid compound, the polyester having an index of crystallinity of from 0.6 to 1.5, and a glass transition temperature of 0° C. or more and less than 40° C., wherein the alcohol component comprises 60 to 90% by mol of a linear aliphatic diol having 4 to 10 carbon atoms and 10 to 40% by mol of a branched aliphatic diol having 3 to 10 carbon atoms.

2. The toner according to claim 1, wherein a molar ratio of the alcohol component to the carboxylic acid component is from 100/70 to 100/120.

3. The toner according to claim 1, further comprising a releasing agent having a melting point of from 50° C. to 100° C.

4. The toner according to claim 1, wherein the polyester has a saturated water content under environmental conditions of a temperature of 40° C. and relative humidity of 90% of from 0.1 to 0.8% by weight.

5. The toner according to claim 1, wherein the polyester has an acid value of from 1 to 50 mgKOH/g.

6. The toner according to claim 1, wherein the polyester has a highest temperature of endothermic peak as determined by a differential scanning calorimeter of from 60° C. to 150° C.

7. A toner for electrophotography comprising a resin binder and a colorant, wherein the resin binder comprises a crystalline polyester in an amount 80% or more by weight of the resin binder, wherein the polyester is obtained by polycondensing an alcohol component comprising 60% by mol or more of an aliphatic diol having 3 to 10 carbon atoms and a carboxylic acid component comprising 80% by mol or more of an aromatic dicarboxylic acid compound, with the proviso that the carboxylic acid component comprises 1 to 50% by mol of a polycyclic aromatic dicarboxylic acid compound having 12 or more carbon atoms, the polyester having an index of crystallinity of from 0.6 to 1.5, and a glass transition temperature of from 0° C. to 50° C., wherein the alcohol component comprises 60 to 90% by mol of a linear aliphatic diol having 4 to 10 carbon atoms and 10 to 40% by mol of a branched aliphatic diol having 3 to 10 carbon atoms.

8. The toner according to claim 7, wherein a molar ratio of the alcohol component to the carboxylic acid component is from 100/70 to 100/120.

9. The toner according to claim 7, further comprising a releasing agent having a melting point of from 50° C. to 100° C.

10. The toner according to claim 7, wherein the polyester has a saturated water content under environmental conditions of a temperature of 40° C. and relative humidity of 90% of from 0.1 to 0.8% by weight.

11. The toner according to claim 7, wherein the polyester has an acid value of from 1 to 50 mgKOH/g.

12. The toner according to claim 7, wherein the polyester has a highest temperature of endothermic peak as determined by a differential scanning calorimeter of from 60° C. to 150° C.

* * * * *